United States Patent [19]

Risi

[11] Patent Number: 4,510,782

[45] Date of Patent: Apr. 16, 1985

[54] TORSION COILER

[76] Inventor: Alfred Risi, 117 East Ave., Brantford, Ontario, Canada, N3S 1M1

[21] Appl. No.: 548,037

[22] Filed: Nov. 2, 1983

Related U.S. Application Data

[63] Continuation of Ser. No. 221,809, Dec. 31, 1980, abandoned.

[30] Foreign Application Priority Data

Jun. 24, 1980 [CA] Canada ..... 354674

[51] Int. Cl.[3] ..... B21F 3/04

[52] U.S. Cl. ..... 72/142

[58] Field of Search ..... 72/135, 138, 140, 142, 72/143, 144, 145

[56] References Cited

U.S. PATENT DOCUMENTS

| | | | |
|---|---|---|---|
| 379,373 | 3/1888 | Harvey | 72/144 |
| 1,505,347 | 8/1924 | Hoyt | 72/144 X |
| 2,290,380 | 7/1942 | Pierce | 72/144 X |
| 2,650,638 | 9/1953 | Johnson et al. | 72/143 |
| 3,470,721 | 10/1969 | Scheublein et al. | 72/144 |
| 3,610,006 | 10/1971 | Scheublein et al. | 72/138 X |
| 4,084,420 | 4/1978 | Tsutsumino | 72/138 |
| 4,132,094 | 1/1979 | Missioux | 72/142 X |
| 4,139,141 | 2/1979 | Torngard | 72/142 X |

FOREIGN PATENT DOCUMENTS

| | | | |
|---|---|---|---|
| 1112956 | 8/1961 | Fed. Rep. of Germany | 72/144 |
| 268685 | 4/1927 | United Kingdom | 72/144 |

*Primary Examiner*—E. Michael Combs

*Attorney, Agent, or Firm*—Cushman, Darby & Cushman

[57] ABSTRACT

This invention relates to a lathe for bending and forming metal rods and coiling springs comprising a chuck holding a cylindrical mandrel for rotation, a pick-up pin held on the face of the chuck to hold a portion of a wire in a fixed position on the chuck during rotation, a wire feed guide adjacent the chuck and mandrel and a shut-off control means adapted to stop rotation of the chuck after the wire coiling has advanced to a predetermined linear distance along the mandrel.

4 Claims, 14 Drawing Figures

TORSION COILER

This is a continuation of application Ser. No. 221,809, filed Dec. 31, 1980, abandoned.

This invention relates to a lathe for bending and forming metal rods and coiling springs.

In the prior art there are a number of spring coiling lathes for the coiling of helical springs. However, it is believed that none of these has the advantages offered by the present invention.

It is an object of this invention to provide an improved lathe for the coiling of helical springs which permits repeatable manufacture of springs having legs or points of termination of coiling at any predetermined radial position with respect to the longitudinal axis of the spring.

It is an object of this invention to provide a spring forming lathe for the fabrication of springs of a predetermined length.

It is an object of this invention to provide a lathe for coiling springs that permits the repeatable manufacture of springs ending in partial coils of a predetermined size.

It is an object of this invention to provide a lathe which may be used for the fabrication of torsion, tension and compression springs.

It is an object of this invention to provide a lathe for wire forming and bending.

The apparatus of this invention comprises a chuck mounted in a conventional manner in a lathe and adapted to hold a cylindrical mandrel for rotation;

a pick up pin adapted to be held on the face of the chuck in at least one radial position about the mandrel being adapted to hold a portion of a wire in a fixed position on the chuck during rotation;

a wire feed guide adjacent the chuck and mandrel being adapted to permit the feeding of a wire to the mandrel from a predetermined angular location with respect to the longitudinal axis of the mandrel and being further adapted to permit the continuous movement of the point of wire feeding along the length of the mandrel;

a shut off control means being adapted to stop the rotation of the chuck after the wire coiling has advanced a predetermined linear distance along the mandrel.

More particularly the apparatus of this invention may have a wire feed guide comprising a rotatable spool slideably mounted through its longitudinal axis on a shaft aligned parallel to the axis of the mandrel. The spool may be adapted with a circular groove about its cylindrical surface to permit the feeding of wire to the mandrel.

The shaft supporting the spool may be mounted on a carriage which may be moved back and forth towards and away from the mandrel so as to locate the shaft at variable predetermined distances from the mandrel.

The shut off control means of the invention may comprise a shut off switch and an activation means adapted to trip the shut off switch upon contact. The cut off switch and activation means may be located a predetermined distance from one another and may be adapted to change position relative to one another at a rate proportional to the rate of rotation of the mandrel so that the activation means will trip the shut off switch after the predetermined distance has been closed thereby stopping the mandrel from further rotation.

More particularly the shut off switch may be a microswitch adapted to be slideably located at predetermined positions along a rod and the activator means may be a threaded spool screwed on to a threaded shaft. The threaded spool may be slideably connected to a guide means adapted to prevent rotation of the threaded spool while permitting it to move along the threaded shaft. The threaded shaft may be driven by a means at a rate proportional to the rate of rotation of the mandrel. The rod and threaded shaft are located parallel to one another so that the threaded spool will trip the microswitch when they pass one another; that is, when they simultaneously intersect a plane perpendicular to the axis of the rod and the threaded shaft.

In the figures which illustrate a preferred embodiment of this invention,

Figure 7:
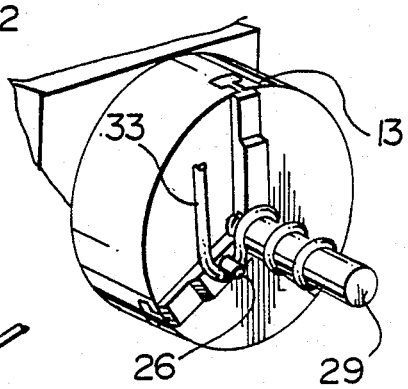
FIG. 7 is an illustration of an alternative embodiment of the apparatus for bending wire.
Figure 8:
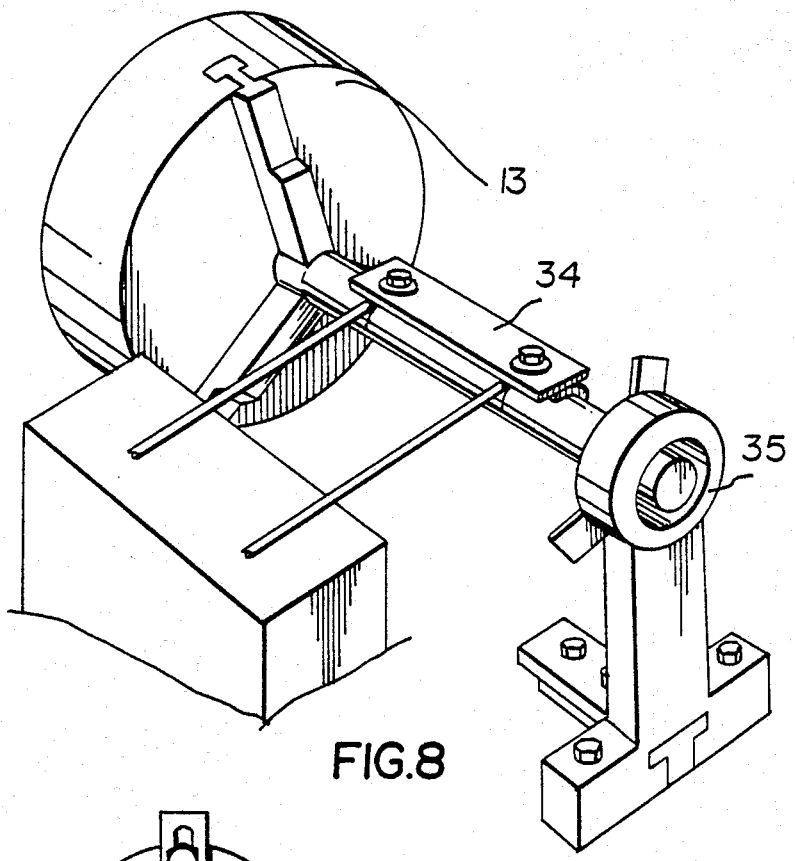
FIG. 8 is a section view taken through the bending mandrel illustrating adjustable means for securing the end of the mandrel not held by the chuck.

FIGS. 10*a*, 10*b*, 10*c*, 10*d*, and 10*e* illustrate a method of bending wire with the embodiment shown in FIGS. 7 and 8.

Figure 1:
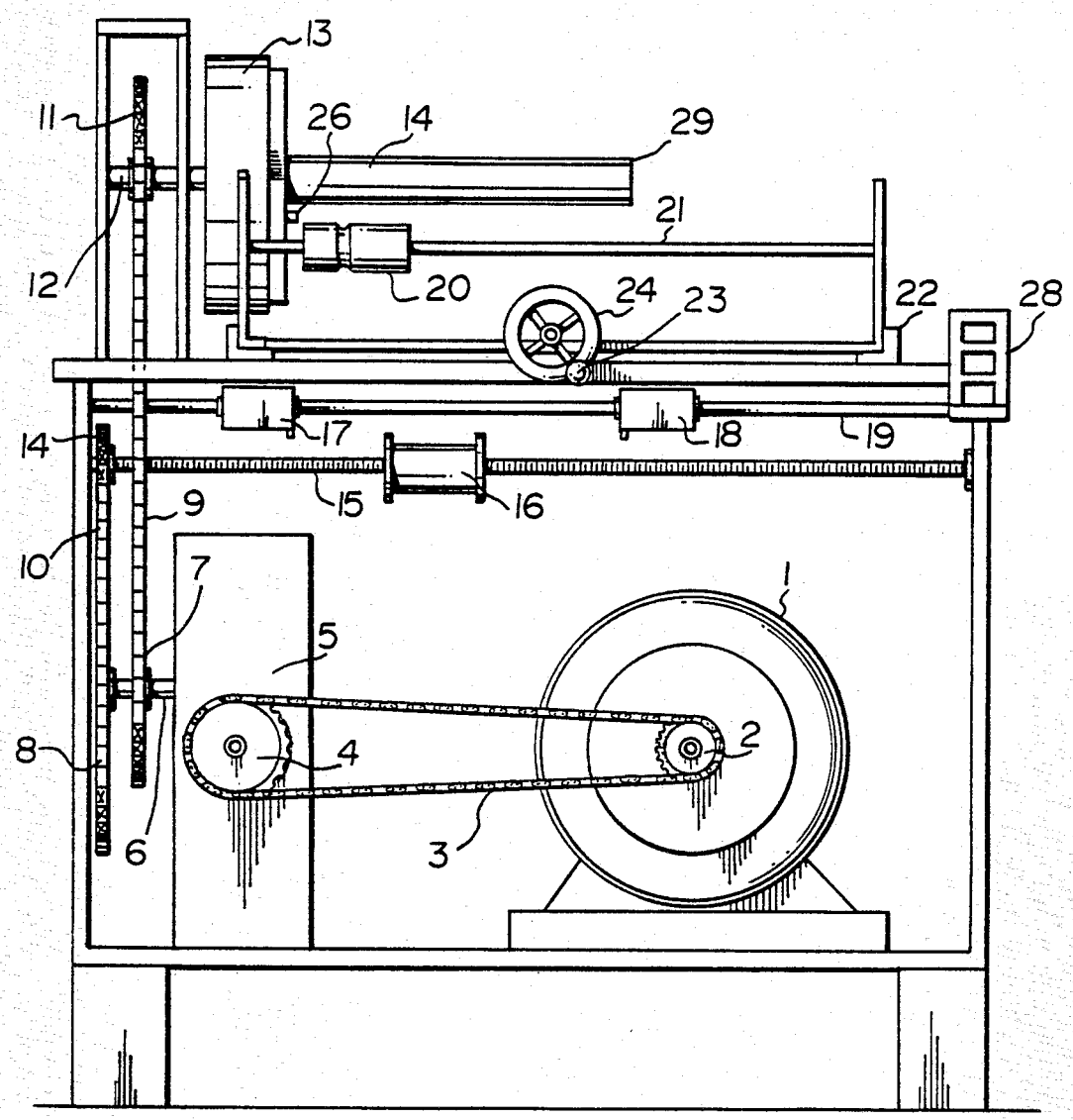
FIG. 1 is a sectional front view of the preferred embodiment.
Figure 2:
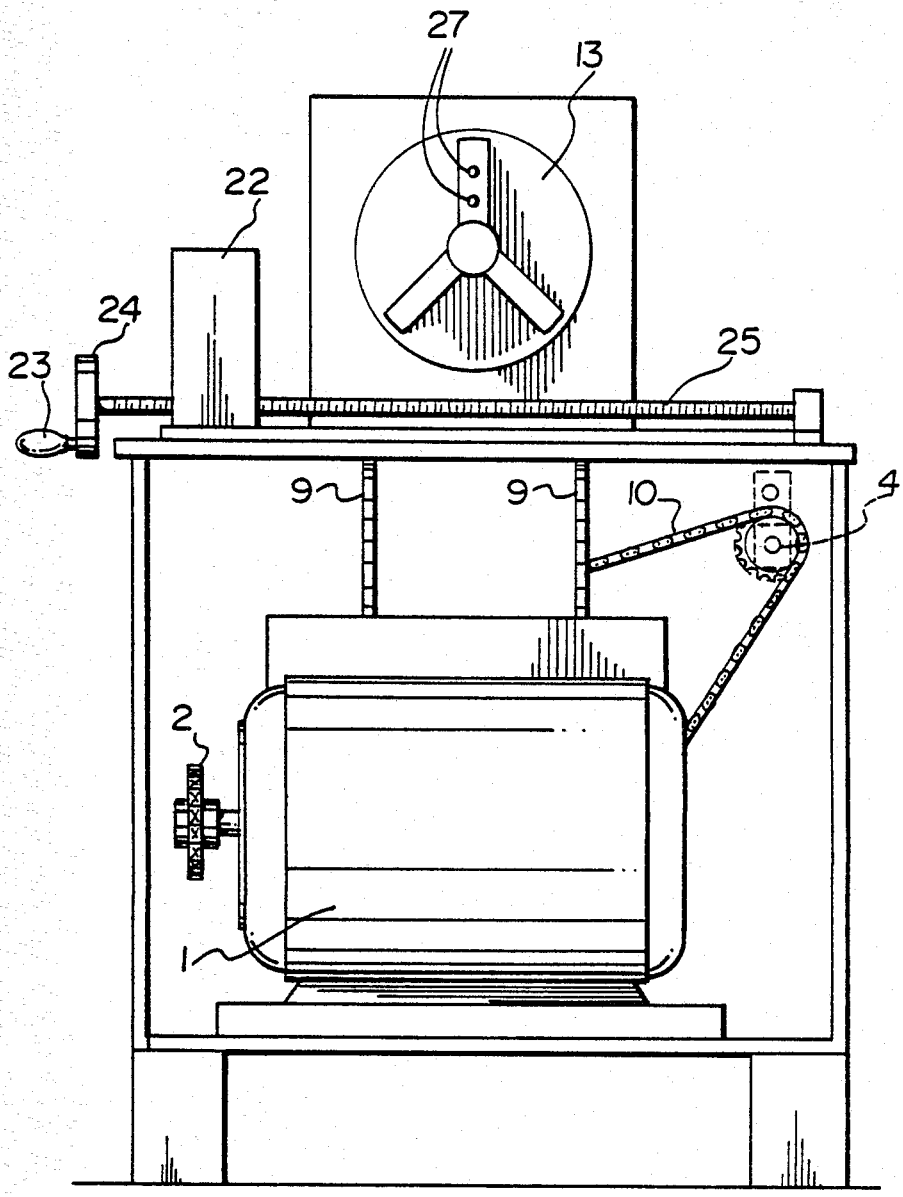
FIG. 2 is an end view of the apparatus of FIG. 1.

As shown in FIGS. 1 and 2, the preferred embodiment of the invention has an electric motor (1) having an electronic brake (not shown). On the drive shaft of the motor (1) is fitted a sprocket (2) which drives chain (3) which in turn drives sprocket (4) on a gear reduction box (5). Shaft (6) extends from gear reduction box (5) and is fitted with sprockets (7) and (8), which drive chains (9) and (10) respectively. Chain (9) drives sprocket (11), shaft (12) and chuck (13) and mandrel (14). Chain (10) drives sprocket (14) and threaded shaft (15) which turns through threaded spool (16) which is slideably mounted on the frame to prevent rotation but to allow the spool (16) to move linearly back and forth along shaft (15).

Two microswitches (17) and (18) are mounted on a shaft (19) which is adjacent to and parallel to shaft (15). Shafts (15) and (19) are close enough to one another to permit spool (16) to trip microswitches (17) and (18) when it reaches them while travelling along shaft (15). Microswitches (17) and (18) are adjustable in that they may be positioned anywhere along shaft (19). Both microswitches are connected electrically to control means (not shown) which applies the electric brake and stops the motor (1) when either of the microswitches are tripped.

Wire being fed to the mandrel (14) passes over guide (20) which is mounted on a shaft (21) in a manner which permits guide (20) to rotate about shaft (21) and to slide along its length. Shaft (21) is mounted parallel to the axis of the mandrel on carriage (22) which is adapted to be slid to and fro in a direction perpendicular to the direction of the shaft (21). Adjustment of carriage (22) in such direction is made by turning handle (23) which rotates wheel (24) and attached shaft (25) which is threaded through carriage (22). In this manner the guide (20) may be moved closer to or farther from the mandrel (14) as desired.

The wire fed to the mandrel (14) passing over guide (20) is picked up by pick up pin (26) mounted in one of holes (27) in the face of the chuck (13). Holes (27) may be wherever it is considered convenient in the face of the chuck. Accordingly, pin (26) may be adjusted by moving it from one hole to another as desired. Pick up pin (26) acts as a stop to catch and hold the wire against movement with respect to the chuck (13) during rotation. Accordingly, the combined action of pick up pin (26) and guide (20) forces the wire about the mandrel (14) when the chuck (13) is rotated in a direction to force the wire against both pin and guide.

Figure 3:
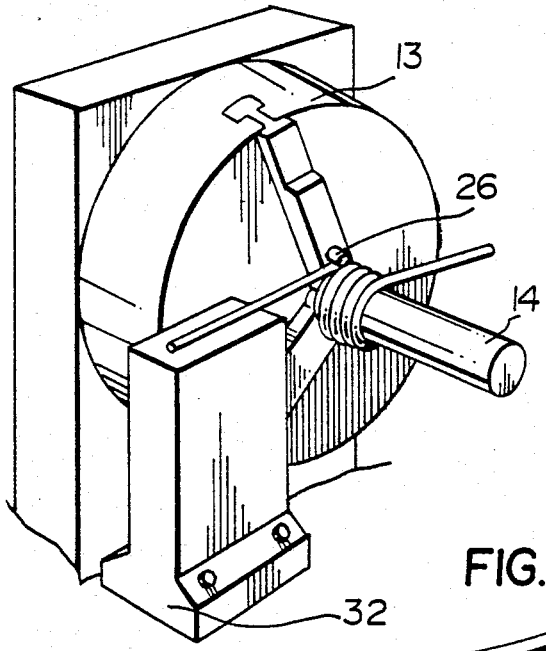
FIG. 3 is a sketch of the apparatus of FIG. 1 fitted with a mandrel for the fabrication of torsion springs.

In FIG. 3 there is shown a torsion spring which has been fabricated on the apparatus of FIG. 1 in the manner described. However, the guide means (20) and carriage (22) has been replaced by jig guide (32) for wire bending of the ends of the spring.

In operation the microswitch (17) is positioned along shaft (19) at an arbitrary starting point. The motor (1) is then run in reverse until spool (16) trips microswitch (17) and stops the motor. Then the second microswitch (18) is positioned along shaft (19) at the desired stopping point. The location of the stopping point may be calculated or determined empirically by trial and error. Essentially the linear distance between the microswitches (17) and (18) will be equal to the length of the spool (16) plus a distance proportional to the linear length of the spring to be fabricated. The calculation of the proportional distance between the microswitches will be made upon determination of the number of coils or partial coils in the spring to be fabricated, the distance, if any, between the coils, the relationship of the angular rotation of shaft (19) to that of shaft (15) and the pitch of the thread of shaft (15) which gives the space that spool (16) will advance along shaft (19) for each complete rotation of shaft (19).

Otherwise an operator may fabricate a test spring using manual controls (28), note the final position of the spool (16) and then set microswitch (18) at a position where it would be tripped by the spool (16) when it advanced to that final position.

Figure 5:
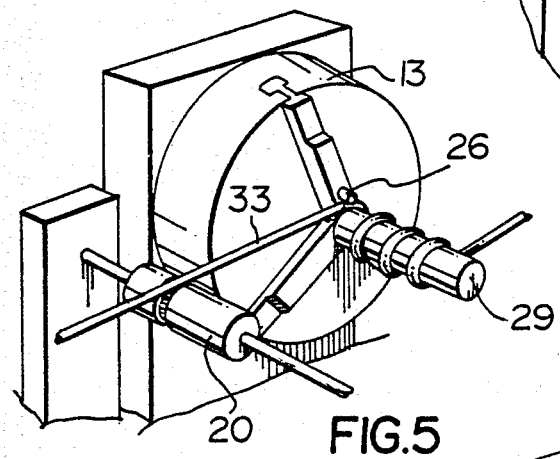
FIG. 5 is an illustration of a compression coil spring being wound on the mandrel.
Figure 4:
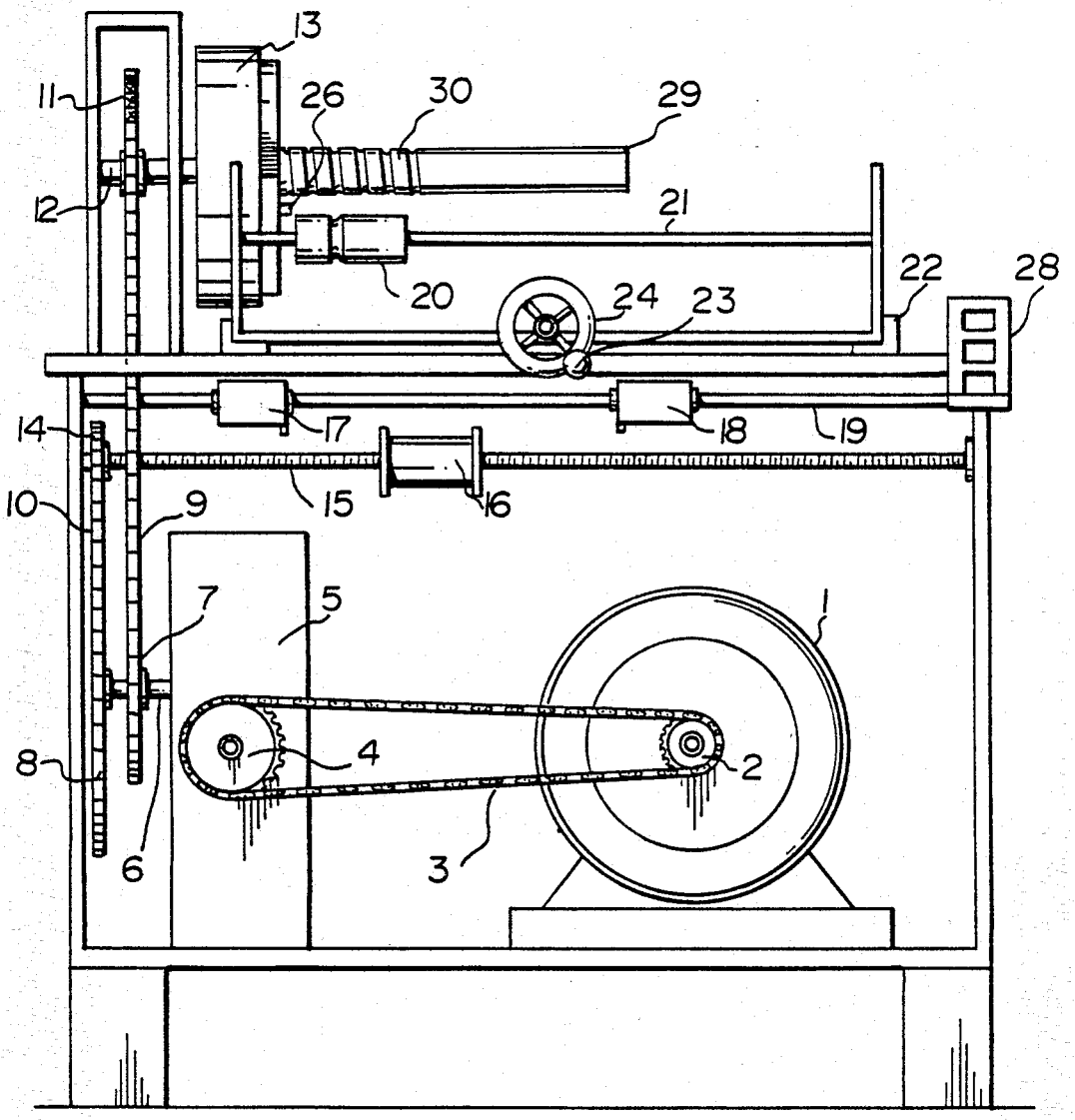
FIG. 4 is a sketch of the apparatus of FIG. 1 having a grooved mandrel for the fabrication of compression springs.

For the purpose of making compression springs having spaces between the coils, a mandrel having a grooved surface may be used instead of the usual mandrel. This is illustrated in FIGS. 4 and 5. The grooves mandrel (29) is shown with groove (30) cut in a spiral along its length. Then as the wire is fed to the mandrel it follows the groove (30) to produce a coil spring having the coils spaced apart in the same manner as the groove. For different spacing, different grooves may be used. In FIG. 5, there is illustrated a wire bent to compression spring form on such a grooved mandrel 29.

Figure 6:
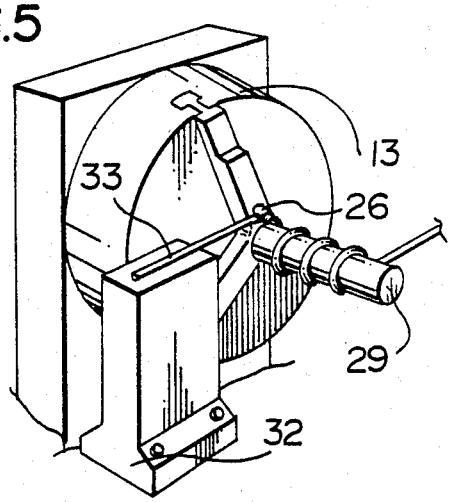
FIG. 6 is an illustration of a spring on a mandrel having a jig in place for wire bending and forming of a leg of the spring.

FIG. 6 illustrates another adaptation of the preferred embodiment of this apparatus in which the guide (20) is replaced by jig (32). By placing the microswitches (17) and (18) an appropriate distance apart and by placing the leg (33) on a jig (32) near the pickup pin (26) rotation of chuck (13) will be such that the leg (33) will be bent around the pickup pin (26) by the jig (32) as desired. In FIG. 7, the bent wire leg (33) is shown.

Figure 9:
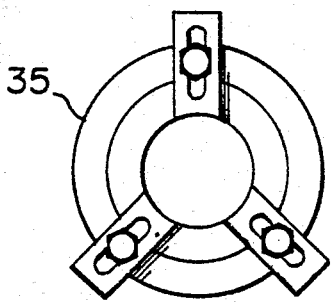
FIG. 9 is a sectional view taken through the mandrel which illustrates an adjustable rotatable holding means to support the free end of the mandrel.
Figure 10A:
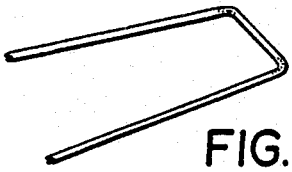
Figure 10B:
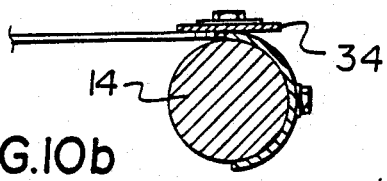
Figure 10C:
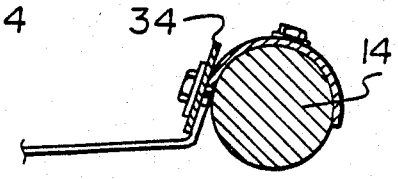
Figure 10E:
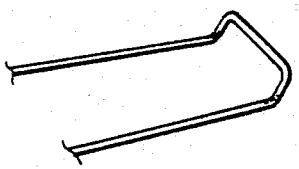
Figure 10D:
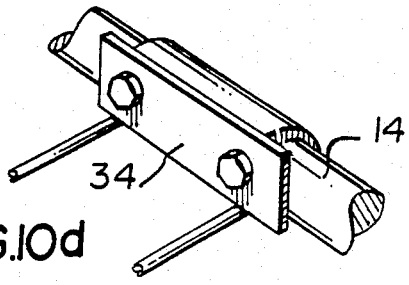

In FIG. 8 a further embodiment of the apparatus is shown in which a plate (34) is bolted to the mandrel in a manner which permits the insertion of a portion of a wire to be bent between the plate and the mandrel. The free end of the mandrel not held by the chuck (13) may be mounted in adjustable rotatable securing means (35) which is illustrated in a sectional view taken through the mandrel in FIG. 9. The process of bending the wire using apparatus illustrated in FIG. 8 is shown sequentially in FIGS. 10*a* through 10*e*. The portion of a wire shown in FIG. 10*a* is inserted between plate (34) and mandrel (14). The mandrel is rotated to bend the wire to the desired angle as shown in FIGS. 10*c* and 10*d*. The completed bent wire portion is illustrated in FIG. 10*e*.

It will be appreciated by those skilled in the art that modifications of the above described apparatus are possible without departing from the principle of the invention.

The embodiments of the invention in which an exclusive property or privilege is claimed are defined as follows:

1. An apparatus for producing from high carbon spring steel feedstock helically coiled torsion springs of the type having leg members at predetermined radial positions with respect to the longitudinal axis of the springs, said apparatus comprising in combination:

a chuck including a cylindrical mandrel mounted in a lathe for rotational movement;

pick-up pin means positioned on the face of said chuck at a predetermined radial dimension relative to the elongated axis of said mandrel for holding a portion of said stock in a fixed position during rotation of said chuck and for establishing an initial feed point of said stock adjacent said mandrel;

feed guide means for guiding said stock to said mandrel during rotation of said mandrel and for establishing successive stock feed points adjacent said mandrel along the longitudinal axis thereof, said successive stock feed points corresponding to successive convolutions of said stock around said mandrel, said guide means including spool means defining a guide groove in which said stock is accepted and advanced towards said mandrel, and carriage means disposed adjacent said mandrel, means for slideably mounting said spool means on said carriage means to permit unrestrained rectilinear movement of said spool means thereon in a direction substantially parallel to said elongated axis of said mandrel while yet permitting said mandrel to freely rotate to permit feeding of said stock towards said mandrel and to permit rectilinear feeding movement of said feedstock in a direction substantially parallel to said elongated axis so that successive stock feed points are established for each successive convolution of said feedstock around said mandrel during rotation of said chuck;

drive means operatively connected to said chuck for rotating said chuck;

control means operatively connected to said drive means for establishing the periods in which said chuck is permitted to rotate thereby establishing the axial length of said spring coiled around said mandrel and the radial positions of said leg members, said control means including first switch means for establishing said initial stock feed point and for stopping said drive means when said first switch means is activated, and second switch means for establishing the end of said coiled spring and for stopping said drive means when said second switch means is activated, means mounting said first and second switch means for movable positioning along an axis substantially parallel to said elongated axis of said mandrel for permitting said first and second switch means to be positioned relative to one another to define an axial space therebetween; and switch activation means operatively connected to said drive means and disposed in said axial space for movement between said first and second switch means, said switch activation means being movable between said first switch means and second switch means at a linear rate proportional to the rate of axial advance of said successive feedstock points along said mandrel for permitting coiling of said feedstock around said mandrel when said activation means is traversing said axial space and for activating said first or second switch means to stop rotation of said drive means and thus to responsively stop coiling of said feedstock around said mandrel; whereby said leg members of said coiled spring can be formed while said chuck is stopped and thereby said positioning of said first and second switch means relative to one another not only establishes the axial length of said coiled spring but also the radial positions of said leg members.

2. The apparatus of claim 1 in which the control means comprises a shut-off switch and an activation means for tripping the shut-off switch upon contact, said shut-off switch and activation means being located at positions a predetermined distance from one another and including positioning means permitting said switch and said activation means to be movable relative to one another at a rate proportional to the rate of rotation of said mandrel so that said activation means trips said shut-off switch after said predetermined distance has been traversed thereby stopping further rotation of the mandrel.

3. The apparatus of claim 2 in which the shut-off switch is a microswitch adapted to be slideably located at predetermined positions along a rod and the activation means is a threaded spool screwed onto a threaded shaft, said threaded spool being slideably connected to a guide means adapted to prevent rotation of the threaded spool while permitting it to move along the threaded shaft, said threaded shaft being driven by said drive means at a rate proportional to the rate of rotation of the mandrel, said rod and said threaded shaft being parallel to one another and located to permit the threaded spool to trip the microswitch when they simultaneously intersect a plane perpendicular to the axis of the rod and the threaded shaft.

4. The apparatus of claim 3 wherein said carriage means is provided with means for transversely locating said feed guide means at variable predetermined distances from said mandrel.

* * * * *